US008062735B2

(12) United States Patent
Bi et al.

(10) Patent No.: US 8,062,735 B2
(45) Date of Patent: Nov. 22, 2011

(54) RETROREFLECTIVE SECURITY FEATURES IN SECURE DOCUMENTS

(75) Inventors: Daoshen Bi, Boxborough, MA (US); Robert L. Jones, Andover, MA (US); Chris Collins, Burlington, MA (US)

(73) Assignee: L-1 Secure Credentialing, Inc., Billerica, MA (US)

( * ) Notice: Subject to any disclaimer, the term of this patent is extended or adjusted under 35 U.S.C. 154(b) by 737 days.

(21) Appl. No.: 11/106,364

(22) Filed: Apr. 13, 2005

(65) Prior Publication Data

US 2005/0258637 A1 Nov. 24, 2005

Related U.S. Application Data

(60) Provisional application No. 60/562,174, filed on Apr. 13, 2004.

(51) Int. Cl.
*B42D 15/10* (2006.01)

(52) U.S. Cl. ..... 428/195.1; 428/323; 264/400

(58) Field of Classification Search ..... 428/40.1, 428/195.1, 323; 283/91
See application file for complete search history.

(56) References Cited

U.S. PATENT DOCUMENTS

| | | | | |
|---|---|---|---|---|
| 4,011,435 | A * | 3/1977 | Phelps et al. | 235/454 |
| 4,200,875 | A | 4/1980 | Galanos | |
| 4,634,220 | A | 1/1987 | Hockert et al. | |
| 4,650,283 | A * | 3/1987 | Orensteen et al. | 359/537 |
| 5,169,707 | A * | 12/1992 | Faykish et al. | 428/195.1 |
| 5,508,105 | A | 4/1996 | Orensteen et al. | |
| 5,510,178 | A * | 4/1996 | Olsen et al. | 428/32.71 |
| 5,591,527 | A * | 1/1997 | Lu | 428/411.1 |
| 5,656,360 | A * | 8/1997 | Faykish et al. | 428/195.1 |
| 5,988,821 | A * | 11/1999 | Tanaka et al. | 359/536 |
| 6,024,455 | A | 2/2000 | O'Neill et al. | |
| 6,120,882 | A | 9/2000 | Faykish et al. | |
| 6,217,175 | B1 * | 4/2001 | Wong et al. | 359/534 |
| 6,288,842 | B1 | 9/2001 | Florczak et al. | |
| 2002/0164460 | A1 * | 11/2002 | Bacon, Jr. | 428/195 |
| 2003/0193718 | A1 * | 10/2003 | Budd et al. | 359/536 |
| 2004/0073798 | A1 | 4/2004 | Look et al. | |

OTHER PUBLICATIONS

Flick, E.W. "Industrial Synthetic Resins Handbook". (1991), 2nd ed. Section V-Curing Resins, p. 301.*

Cambridge Advanced Learner's Dictionary. Definition of "Location". http://dictionary.cambridge.org/dictionary/british/location_1. Retrieved Apr. 9, 2010.*

* cited by examiner

*Primary Examiner* — David Sample
*Assistant Examiner* — Prashant J Khatri
(74) *Attorney, Agent, or Firm* — Mintz, Levin, Cohn, Ferris, Glovsky and Popeo, P.C.

(57) ABSTRACT

Retroreflective material is used to create security features in secure documents. Retroreflective material in the document or sheets used for document creation is laser engraved to create optically variable images, identification quality gray-scale images, different directional images viewable at corresponding angles of incidence, multidimensional images, and floating images. High refractive index glass beads are selectively applied to areas of a document surface using a variety of techniques. The beads may be applied in the form of a predetermined or personalized pattern.

4 Claims, No Drawings

RETROREFLECTIVE SECURITY FEATURES IN SECURE DOCUMENTS

RELATED APPLICATION DATA

This patent application claims priority to U.S. Provisional Application 60/562,174, filed Apr. 13, 2004, which is hereby incorporated by reference.

This application is related to the following U.S. patent applications:

- Laser Engraving Methods and Compositions, and Articles Having Laser Engraving Thereon," (application Ser. No. 10/326,886, filed Dec. 20, 2002, inventors Robert Jones and Brian Labrec)
- Laser Engraving Methods and Compositions and Articles Having Laser Engraving Thereon (application Ser. No. 10/803,538, Inventor Brian Labrec);
- Laser Engraving Methods and Compositions and Articles Having Laser Engraving Thereon (Application No. 60/504,352, filed Sep. 19, 2003—Inventors Brian Labrec and Robert Jones);
- Increasing Thermal Conductivity of Host Polymer Used with Laser Engraving Methods and Compositions (application Ser. No. 10/677,092, filed Sep. 30, 2003);
- Document Laminate Formed From Different Polyester Materials (application Ser. No. 10/692,463, filed Oct. 22, 2003, Inventor Brian Labrec);
- Optically Variable Security Features Having Covert Forensic Features (application Ser. No. 10/673,048, filed Sep. 26, 2003, Inventors Robert Jones and Daoshen Bi);
- Identification Document (Application No. 60/471,429, filed May 16, 2003, inventors Robert Jones, Brian Labrec, Daoshen Bi, and Thomas Regan);
- Use of Pearlescent and Other Pigments to Create Security Documents (application Ser. No. 09/969,200, Inventors Bentley Bloomberg and Robert L. Jones, filed Oct. 2, 2001);
- Multiple Image Security Features for Identification Documents and Methods of Making Same (application Ser. No. 10/325,434, filed Dec. 18, 2002—Inventors Brian Labrec, Joseph Anderson, Robert Jones, and Danielle Batey);
- Laser Etched Security Features for Identification Documents and Methods of Making Same (application Ser. No. 10/330,033, filed Dec. 24, 2002—Inventors George Theodossiou and Robert Jones);
- Image Processing Techniques for Printing Identification Cards and Documents (application Ser. No. 10,411,354, filed Apr. 9, 2003—Inventors Chuck Duggan and Nelson Schneck);
- Identification Document and Related Methods (Application No. 60/421,254, Inventors: Geoff Rhoads, et al);
- Identification Document and Related Methods (Application No. 60/418,762, Inventors: Geoff Rhoads, et al); and
- Systems, Compositions, and Methods for Full Color Laser Engraving of ID Documents (application Ser. No. 10/330,034, filed Dec. 24, 2002—Inventor Robert Jones);

Each of the above U.S. Patent documents is herein incorporated by reference.

The present invention is also related to the following U.S. patents, each of which is hereby incorporated by reference:

- "Identification Document," U.S. Pat. No. 6,066,594, inventors Valerie E. Gunn and Janet Schaffner, issued May 23, 2000.

- "Retroreflective Film," U.S. Pat. No. 3,801,183, inventors Charles V. Sevelin et al., issued Apr. 2, 1974;
- "Transparent Retroreflective Sheets Containing Directional Images and Method for Forming the Same," U.S. Pat. No. 4,688,894, inventor Eric N. Hockert, issued Aug. 25, 1987; and
- "Transparent Sheets Containing Directional Images and Method for Forming Same," Inventors Gerald R. Porter et al, issued Sep. 8, 1987.

The present invention is also related to U.S. patent application Ser. No. 09/747,735, filed Dec. 22, 2000, Ser. No. 09/602,313, filed Jun. 23, 2000, and Ser. No. 10/094,593, filed Mar. 6, 2002, U.S. Provisional Patent Application No. 60/358,321, filed Feb. 19, 2002, as well as U.S. Pat. No. 6,066,594.

Each of the above U.S. Patent documents is herein incorporated by reference in its entirety

TECHNICAL FIELD

The invention generally relates to security features for identification and security documents, and in particular, relates to processing of retroreflective materials to create security features in such documents and resulting document materials.

BACKGROUND

Identification Documents

Identification documents (hereafter "ID documents") play a critical role in today's society. One example of an ID document is an identification card ("ID card"). ID documents are used on a daily basis—to prove identity, to verify age, to access a secure area, to evidence driving privileges, to cash a check, and so on. Airplane passengers are required to show an ID document during check in, security screening and prior to boarding their flight. In addition, because we live in an ever-evolving cashless society, ID documents are used to make payments, access an automated teller machine (ATM), debit an account, or make a payment, etc.

(For the purposes of this disclosure, ID documents are broadly defined herein, and include, e.g., credit cards, bank cards, phone cards, passports, driver's licenses, network access cards, employee badges, debit cards, security cards, visas, immigration documentation, national ID cards, citizenship cards, social security cards, security badges, certificates, identification cards or documents, voter registration cards, police ID cards, border crossing cards, legal instruments, security clearance badges and cards, gun permits, gift certificates or cards, membership cards or badges, etc., etc. Also, the terms "document," "card," "badge" and "documentation" are used interchangeably throughout this patent application.).

Many types of identification cards and documents, such as driving licenses, national or government identification cards, bank cards, credit cards, controlled access cards and smart cards, carry thereon certain items of information which relate to the identity of the bearer. Examples of such information include name, address, birth date, signature and photographic image; the cards or documents may in addition carry other variant data (i.e., data specific to a particular card or document, for example an employee number) and invariant data (i.e., data common to a large number of cards, for example the name of an employer). All of the cards described above will hereinafter be generically referred to as "ID documents".

As those skilled in the art know, ID documents such as drivers licenses can contain information such as a photographic image, a bar code (which may contain information specific to the person whose image appears in the photographic image, and/or information that is the same from ID document to ID document), variable personal information, such as an address, signature, and/or birthdate, biometric information associated with the person whose image appears in the photographic image (e.g., a fingerprint), a magnetic stripe (which, for example, can be on the a side of the ID document that is opposite the side with the photographic image), and various security features, such as a security pattern (for example, a printed pattern comprising a tightly printed pattern of finely divided printed and unprinted areas in close proximity to each other, such as a fine-line printed security pattern as is used in the printing of banknote paper, stock certificates, and the like).

An exemplary ID document can comprise a substrate or core layer (which can be pre-printed), such as a light-colored, opaque material (e.g., polycarbonate, TESLIN (available from PPG Industries) polyvinyl chloride (PVC) material, etc). In certain instances and with certain printing or information forming technologies, variable or personalized data can be formed directly on the substrate or core layer. In other instances, the core layer may be coated and/or laminated with another material to enable printing or other methods of forming information. For example, the substrate or core layer can be laminated with a transparent material, such as clear polycarbonate or PVC to form a so-called "card blank".

Information, such as variable personal information (e.g., photographic information), can then formed on the card blank using one or more methods, such as laser xerography, Indigo, intaglio, laser engraving or marking, inkjet printing, thermal or mass transfer printing, dye diffusion thermal transfer ("D2T2") printing, (described in commonly assigned U.S. Pat. No. 6,066,594, which is incorporated herein by reference in its entirety.), etc. The information can, for example, comprise an indicium or indicia, such as the invariant or nonvarying information common to a large number of identification documents, for example the name and logo of the organization issuing the documents. The information may be formed by any known process capable of forming the indicium on the specific core material used.

Certain technologies for forming or printing information may require further protection of the information, so an additional layer of transparent overlaminate can be coupled to the core layer or card blank and the information printed thereon, as is known by those skilled in the art. Illustrative examples of usable materials for overlaminates include polycarbonate, biaxially oriented polyester, or other optically clear durable plastic film.

In the production of images useful in the field of identification documentation, it may be desirable to embody into a document (such as an ID card, drivers license, passport or the like) data or indicia representative of the document issuer (e.g., an official seal, or the name or mark of a company or educational institution) and data or indicia representative of the document bearer (e.g., a photographic likeness, name or address). Typically, a pattern, logo or other distinctive marking representative of the document issuer will serve as a means of verifying the authenticity, genuineness or valid issuance of the document. A photographic likeness or other data or indicia personal to the bearer will validate the right of access to certain facilities or the prior authorization to engage in commercial transactions and activities.

Identification documents, such as ID cards, having printed background security patterns, designs or logos and identification data personal to the card bearer have been known and are described, for example, in U.S. Pat. No. 3,758,970, issued Sep. 18, 1973 to M. Annenberg; in Great Britain Pat. No. 1,472,581, issued to G. A. O. Gesellschaft Fur Automation Und Organisation mbH, published Mar. 10, 1976; in International Patent Application PCT/GB82/00150, published Nov. 25, 1982 as Publication No. WO 82/04149; in U.S. Pat. No. 4,653,775, issued Mar. 31, 1987 to T. Raphael, et al.; in U.S. Pat. No. 4,738,949, issued Apr. 19, 1988 to G. S. Sethi, et al.; and in U.S. Pat. No. 5,261,987, issued Nov. 16, 1993 to J. W. Luening, et al. All of the aforementioned documents are hereby incorporated by reference.

Identification documents of the types mentioned above can take a number of forms, depending on cost and desired features. For example, some ID documents comprise highly plasticized poly(vinyl chloride) or have a composite structure with polyester laminated to 0.5-2.0 mil (13-51 .mu.m) poly (vinyl chloride) film, which provides a suitable receiving layer for heat transferable dyes which form a photographic image, together with any variant or invariant data required for the identification of the bearer. These data are subsequently protected to varying degrees by clear, thin (0.125-0.250 mil, 3-6 .mu.m) overlay patches applied at the printhead, holographic hot stamp foils (0.125-0.250 mil 3-6 .mu.m), or a clear polyester laminate (0.5-10 mil, 13-254 .mu.m) supporting common security features. These last two types of protective foil or laminate sometimes are applied at a laminating station separate from the printhead. The choice of laminate dictates the degree of durability and security imparted to the system in protecting the image and other data.

One response to the problem of counterfeiting ID documents has involved the integration of verification features that are difficult to copy by hand or by machine, or which are manufactured using secure and/or difficult to obtain materials. One such verification feature is the use in the card of a signature of the card's issuer or bearer. Other verification features have involved, for example, the use of watermarks, biometric information, microprinting, covert materials or media (e.g., ultraviolet (UV) inks, infrared (IR) inks, fluorescent materials, phosphorescent materials), optically varying images, fine line details, validation patterns or marking, and polarizing stripes. These verification features are integrated into an identification card in various ways, as appreciated by those skilled in the art, and they may be visible or invisible (covert) in the finished card. If invisible, they can be detected by viewing the feature under conditions which render it visible. At least some of the verification features discussed above have been employed to help prevent and/or discourage counterfeiting.

Covert security features are those features whose presence is not visible to the user without the use of special tools (e.g., UV or IR lights, digital watermark readers) or knowledge. In many instances, a covert security feature is normally invisible to a user. Some technologies that involve invisible features require the use of specialized equipment, such as a detector or a device capable of reading digital watermarks. One type of covert security feature is the printing of information (images, designs, logos, patterns, text, etc.) in a material that is not visible under normal lighting conditions, but can be viewed using a special non-visible light source, such as an ultraviolet (UV) or infrared (IR) light source. Use of UV and/or IR security features can be advantageous because although the devices (for example, UV and/or IR light sources) required to see and use such features are commonly available at a reasonable cost, the ability to manufacture and/or copy at least some implementations of such features is far less common and can be very costly. UV and IR based covert security features thus can help deter counterfeiters because the features cannot be copied by copiers or scanners and are extremely difficult to manufacture without the requisite know-how, equipment, and materials.

In the foregoing discussion, the use of the word "ID document" is broadly defined and intended to include all types of ID documents, including (but not limited to), documents, magnetic disks, credit cards, bank cards, phone cards, stored value cards, prepaid cards, smart cards (e.g., cards that include one more semiconductor chips, such as memory devices, microprocessors, and microcontrollers), contact cards, contactless cards, proximity cards (e.g., radio frequency (RFID) cards), passports, driver's licenses, network access cards, employee badges, debit cards, security cards, visas, immigration documentation, national ID cards, citizenship cards, social security cards, security badges, certificates, identification cards or documents, voter registration and/or identification cards, police ID cards, border crossing cards, security clearance badges and cards, legal instruments, gun permits, badges, gift certificates or cards, membership cards or badges, and tags. Also, the terms "document," "card," "badge" and "documentation" are used interchangeably throughout this patent application.). In at least some aspects of the invention, ID document can include any item of value (e.g., currency, bank notes, and checks) where authenticity of the item is important and/or where counterfeiting or fraud is an issue.

In addition, in the foregoing discussion, "identification" at least refers to the use of an ID document to provide identification and/or authentication of a user and/or the ID document itself. For example, in a conventional driver's license, one or more portrait images on the card are intended to show a likeness of the authorized holder of the card. For purposes of identification, at least one portrait on the card (regardless of whether or not the portrait is visible to a human eye without appropriate stimulation) preferably shows an "identification quality" likeness of the holder such that someone viewing the card can determine with reasonable confidence whether the holder of the card actually is the person whose image is on the card. "Identification quality" images, in at least one embodiment of the invention, include covert images that, when viewed using the proper facilitator (e.g., an appropriate light or temperature source), provide a discemable image that is usable for identification or authentication purposes.

There are a number of reasons why an image or information on an ID document might not qualify as an "identification quality" image. Images that are not "identification quality" may be too faint, blurry, coarse, small, etc., to be able to be discemable enough to serve an identification purpose. An image that might not be sufficient as an "identification quality" image, at least in some environments, could, for example, be an image that consists of a mere silhouette of a person, or an outline that does not reveal what might be considered essential identification essential (e.g. hair or eye color) of an individual.

Of course, it is appreciated that certain images may be considered to be "identification quality" if the images are machine readable or recognizable, even if such images do not appear to be "identification quality" to a human eye, whether or not the human eye is assisted by a particular piece of equipment, such as a special light source. For example, in at least one embodiment of the invention, an image or data on an ID document can be considered to be "identification quality" if it has embedded in it machine-readable information (such as digital watermarks or steganographic information) that also facilitate identification and/or authentication.

Further, in at least some embodiments, "identification" and "authentication" are intended to include (in addition to the conventional meanings of these words), functions such as recognition, information, decoration, and any other purpose for which an indicia can be placed upon an article in the article's raw, partially prepared, or final state. Also, instead of ID documents, the inventive techniques can be employed with product tags, product packaging, business cards, bags, charts, maps, labels, etc., etc., particularly those items including marking of an laminate or over-laminate structure. The term ID document thus is broadly defined herein to include these tags, labels, packaging, cards, etc.

"Personalization", "Personalized data" and "variable" data are used interchangeably herein, and refer at least to data, images, and information that are "personal to" or "specific to" a specific cardholder or group of cardholders. Personalized data can include data that is unique to a specific cardholder (such as biometric information, image information, serial numbers, Social Security Numbers, privileges a cardholder may have, etc.), but is not limited to unique data. Personalized data can include some data, such as birthdate, height, weight, eye color, address, etc., that are personal to a specific cardholder but not necessarily unique to that cardholder (for example, other cardholders might share the same personal data, such as birthdate). In at least some embodiments of the invention, personal/variable data can include some fixed data, as well. For example, in at least some embodiments, personalized data refers to any data that is not pre-printed onto an ID document in advance, so such personalized data can include both data that is cardholder-specific and data that is common to many cardholders. Variable data can, for example, be printed on an information-bearing layer of the ID card using thermal printing ribbons and thermal printheads.

The terms "indicium" and indicia as used herein cover not only markings suitable for human reading, but also markings intended for machine reading. Especially when intended for machine reading, such an indicium need not be visible to the human eye, but may be in the form of a marking visible only under infra-red, ultra-violet or other non-visible radiation. Thus, in at least some embodiments of the invention, an indicium formed on any layer in an identification document (e.g., the core layer) may be partially or wholly in the form of a marking visible only under non-visible radiation. Markings comprising, for example, a visible "dummy" image superposed over a non-visible "real" image intended to be machine read may also be used.

SUMMARY

The invention provides retroreflective security features and related methods for creating them for secure documents, such as identification documents. One aspect of the invention relates to laser engraving of retroreflective material. In particular, one aspect of the invention is a secure document comprising a core layer, and a retroreflective material applied to the core layer. The retroreflective material is on a surface of the secure document and different directional images are laser engraved in a common location on the retroreflective material at corresponding first and second angles of incidence. This disclosure describes various ways of applying the retroreflective material, including using retroreflective sheets, or depositing beads to a selected area to form a desired pattern or shape on the document surface.

Other inventive aspects include retroreflective materials having images laser engraved in the material at corresponding angles and depths to create security features for documents, including optically variable images, identification quality grayscale images, different directional images viewable at corresponding angles of incidence, multidimensional images, and floating images, to name a few. Other inventive aspects of laser engraved retroreflective material are detailed further below, along with the inventive methods for making them.

Another aspect of the invention is a secure document comprising a retroreflective material, such as HRI beads, applied to a selected area in the form of a pre-determined or personalized pattern. In particular, a secure document comprises a core layer, a host layer on the core layer, and a retroreflective material applied to the host layer. The retroreflective material is selectively applied to an area of the document's surface forming a pre-determined or personalized pattern, and the retroreflective material is embedded in the host layer in a shape of the pattern. This pattern may be a pre-determined shape to coincide with features printed underneath it on the document, or may convey personal or graphical information associated with the document bearer or issuer.

Another aspect of the invention is a method of applying high refractive index beads to a document structure. This method forms a host layer on a document substrate layer in a shape of a pattern, and deposits beads on the host layer such that the beads adhere to the host layer, forming a pattern of beads in the shape of the pattern. The pattern may be a simple polygonal shape designed to operate in conjunction with imagery underneath the retroreflective pattern on the document substrate. Alternatively, it may convey graphical patterns or even personalized information of the document bearer. Alternative ways of forming the pattern include printing a coating in the shape of the pattern, or using various masking techniques to prepare a selected area of the host layer in the shape of the desired pattern. Inventive techniques further include using a variation of this method to form lenticular structures by selectively placing the beads so that they form a lenticular lens structure and provide optical effects when used in conjunction with information printed on the substrate of the document underneath the lens structure.

DETAILED DESCRIPTION

Retroreflective Films.

It is known to use retroreflective films for security laminates on articles such as identification documents. One brand of retroreflective security laminate that has been used as a security film is the CONFIRM brand of security laminate, available from 3M (Minnesota Mining and Manufacturing) Innovative Properties of St. Paul, Minn. CONFIRM includes a monolayer of glass microspheres with a partially light transmissive dielectric mirror disposed on the underside of the microspheres. The sheet is retroreflective over its entire surface area and contains a retroreflecting pattern or legend which is obscure in that it is invisible or only faintly visible to the naked eye under diffuse light and does not obstruct any underlying visual information. More information about how CONFIRM is constructed and how it works is described in Sevelin et al., U.S. Pat. No. 3,801,183, the contents of which are hereby incorporated by reference. The reader is presumed to be familiar with retroreflective security films.

Methods have been developed for forming various types of images in the retroreflective film. For example, Galanos, U.S. Pat. No. 4,200,875, describes a method of forming directional images in opaque retroreflective sheeting which comprises a specular reflecting layer disposed behind a monolayer of glass microspheres. In that method, laser irradiation of the retroreflective sheeting in an imagewise fashion causes structural alterations or modifications in the sheet which are viewable as directional images. Images are formed in the sheeting of Galanos by applying laser radiation to the retroreflective sheeting through a mask or pattern. The contents of the Galanos U.S. Patent is hereby incorporated by reference.

Hockert, U.S. Pat. No. 4,688,894, disclosed another method for forming directional images in a retroreflective laminate, where the retroreflective laminate is transparent. In Hockert, a suitable laser beam is directed in an imagewise fashion at a selected angle of incidence to the face of the sheeting. The wavelength of the laser beam is selected such that it is focused by microlenses to form discrete markings in the sheeting at the rear of each microlens which the beam strikes. Each microlens focuses the laser light incident upon it to a small spot—having a diameter that is only a small fraction of the diameter of the microlens—to create a localized marking, e.g., a cavity within an individual microlens, a cavity opening through the back of a microlens, an opening, charring, or other modification within the partially light transmissive mirror, or some combination among these various modifications. These markings may be termed "axial markings", in that the marking associated with each microlens is centered on an axis that extends through the optical center of the microlens and is parallel to, or intersects at a common viewing point or line, the similar axes for the other deformed microlenses in the image area. The resulting set of markings is visible as an image at the angle of incidence of the imaging laser beam.

Hockert particularly describes that his method employs a laser adjusted so as to provide a power density of approximately one megawatt per square centimeter at the sheeting's surface is useful. Hockert s suggest that suitable lasers include pulsed, acousto-optically Q-switched Nd:YAG (Neodymium: Yttrium Aluminum Garnet) lasers, such as the Model 512Q laser available from Control Laser Corporation of Orlando, Fla., which, equipped with a frequency doubler, emits a beam with a wavelength of 532 nanometers in pulses of approximately 200 to 400 nanoseconds in duration.

We have found, however, that we have been able to laser irradiate retroreflective sheeting, using somewhat different laser parameters, in such a way that we can laser engrave identification-quality directional images which, effectively, form an optically variable device within the retroreflective sheeting (e.g., the identification quality directional image is substantially visible in diffuse light at a first viewing angle, but not substantially visible in diffuse light at a second viewing angle).

We also have found that our techniques can be used advantageously to laser irradiate (also referred to herein as laser engrave) the retroreflective sheeting with variable indicia (also referred to as personalized indicia or data), including images, especially personalized data associated with the person associated with the identification document. We can laser engrave the retroreflective sheeting before or after it has been coupled to an identification document.

It should be noted, in the following examples, that although we describe laser engraving of personalized or variable indicia, the invention is not so limited. Laser engraving can, of course, be used to mark the identification document with fixed or non-varying indicia.

EXAMPLE 1

In one embodiment, we produced an identification document, the identification document including a core layer having first and second sides and a laminate layer coupled to the first side of the core layer by an adhesive. The laminate layer is a layer of retroreflective sheeting, such as CONFIRM, where the "exposed lens" side (side with the microspheres) faces outwards and the other side is coupled, via adhesive, to the first side of the core layer.

The core layer in our example was made of opaque silica filled polyolefin, an example of which is TESLIN (available from PPG Industries of Pittsburgh, Pa.). Of course, many other core materials are usable. Core layers for identification documents in accordance with the invention can include many different types of materials, including but not limited to resins, polyesters, polycarbonates, vinyls, acrylates, urethanes, and cellulose based materials, thermosetting material, thermoplastic, polymer, copolymer, polycarbonate, fused polycarbonate, polyester, amorphous polyester, polyolefin, silicon-filled polyolefin, TESLIN, TYVEC, plastic paper, paper, synthetic paper, foamed polypropylene film, polyvinyl chloride, polyethylene, thermoplastic resins, engineering thermoplastic, polyurethane, polyamide, polystyrene, expanded polypropylene, polypropylene, acrylonitrile butadiene styrene (ABS), ABS/PC, high impact polystyrene, polyethylene terephthalate (PET), PET-G, PET-F, polybutylene terephthalate PBT), acetal copolymer (POM), polyetherimide (PEI), polyacrylate, poly(4-vinylpyridine, poly(vinyl acetate), polyacrylonitrile, polymeric liquid crystal resin, polysulfone, polyether nitride, and polycaprolactone.

We laser engraved the identification document (actually, the laminate layer (retroreflective sheeting) of the identification document) using the RSM Powerline E laser marking machine. This machine is a neodymium:yttrium aluminum garnet (Nd:YAG) Acousto-optical pulsed Q-switch machine having laser outputs including both 3 Watt (W) (103D) and 10 W (Powerline E) power outputs. This machine is capable, in pulsed mode, of a maximum power density of 100 MW per square centimeter. This machine can be purchased from Rofin Baasel Lasertech of Boxborough, Mass. The 10 W laser of this device is capable of using a true grey scale marking software compared, which is advantageous for creating grey scale laser engraved images in the retroreflective sheeting. In this machine, the Nd:YAG laser emits light at a wavelength of about 1064 nanometers (nm), at 10 watts max of a beam diameter of 2.3 mm. In this example, we used the 10 W output at a wavelength of 1064 nm, a beam diameter of 2.3 to 10 mm, and a frequency of about 50 Khz (the range of the Powerline E is about 0 to 65 KHz, however, and many other frequencies are usable).

By laser engraving the identification document at an angle (e.g., by turning the identification document to an angle away from normal, e.g., 30 degrees), we created an image in the retroreflective sheeting that is optically variable in that the image is not visible at angles other than angles substantially close to the angles at which the sheeting was laser engraved. For example, we can laser engrave personalized data such as a drivers license identification number or a signature (e.g., a handwriting signature) in an identification document by directing the laser beam towards the retroreflective sheeting that overlays one or more images already formed on a core layer (or on the reverse side of the retroreflective sheeting). At a first angle, the laser engraved image is not visible. At a second angle, the laser engraved image of the signature is visible in the laminate as overlaying the image. When illuminated with focused light, the laser engraved image appears to be substantially dark. This helps to provide a security feature that can authenticate the identification document.

EXAMPLE 2

Same laser engraving conditions as Example 1, using the same identification document of Example 1. Under these conditions, we were able to laser engrave an optically variable, identification quality grayscale image into the retroreflective sheeting.

EXAMPLE 3

Same laser engraving conditions as Example 1, except the laser engraving was not done at an angle relative to the identification document. Under these conditions, we were able to laser engrave a non-optically variable, identification quality grayscale image into the retroreflective sheeting. That is, the grayscale image is visible when viewing the identification document "head on".

EXAMPLE 4

Same laser engraving conditions as Example 1, using the same identification document. Under these conditions, using the laser, we wrote a first piece of variable information (e.g., a signature) to the identification document at a first angle and at a first location and a second piece of variable information (e.g., a drivers license number) to the identification document at the same first location, but at a second angle different than the first angle. When the first location of the identification document is viewed at the first angle, the first piece of variable information becomes visible, but the second piece of variable information is substantially invisible. When the first location of the identification document is viewed at the second angle, the second piece of variable information becomes visible, but the first piece of variable information becomes substantially invisible.

EXAMPLE 5

Same laser engraving conditions as Example 1, using the same identification document. Under these conditions, by varying the laser mark angles and depth of laser engraving, we are able to generate images that appear to be multidimensional and/or that appear to "float".

In additional experiments, we laser engraved personal information of a card holder into a retroflective coating on sample cards. The retroreflective material used in these samples was CONFIRM from 3M Corporation. We used a Rofin 10 watt ND YAG laser. Signatures and serial numbers were engraved on the document surface in the same location, but only visible at different angles.

The specifications of the laser used in these experiments were:

Rofin 10 watt diode pumped YAG laser
Wavelength 1064 nm
160 mm Lens
5× Beam Expander
The marking parameters were:
Focus height of 147 mm (5.75")
Beam Expansion 5×
Power 0.164 to 0.185 watts
Current 18.5 to 18.7 Amps
Frequency 50 KHz
Speed 500 mm/s
Pulse Suppression Step 20; Limit 45

With the above laser specifications and marking parameters, we used a fixture that rotated about the Y axis, which provided the ability to mark 2 separate bits of information (name and serial number) at the same location but viewable at different angles. For example when looking at the card at one angle only the serial number is visible and when looking at a different angle then only the name is visible.

Further Improvments

We expect that many additional technologies and developments can be combined with the teachings disclosed herein to improve the quality and process of performing laser engraving of identification documents that include a sheet of retroreflective laminate. For example, we expressly contemplate combining using the laser marking techniques and structures designed herein with materials that may include additives that improve laser engraving processes, such as are disclosed in each of the following commonly assigned patent applications (which are incorporated by reference):

- Laser Engraving Methods and Compositions, and Articles Having Laser Engraving Thereon,"(application Ser. No. 10/326,886, filed Dec. 20, 2002, inventors Robert Jones and Brian Labrec)
- Laser Engraving Methods and Compositions and Articles Having Laser Engraving Thereon (application Ser. No. 10/803,538, Inventor Brian Labrec);
- Laser Engraving Methods and Compositions and Articles Having Laser Engraving Thereon (Application No. 60/504,352, filed Sep. 19, 2003—Inventors Brian Labrec and Robert Jones);
- Increasing Thermal Conductivity of Host Polymer Used with Laser Engraving Methods and Compositions (application Ser. No. 10/677,092, filed Sep. 30, 2003);

For example, we expect that by using a core made of a material such as polycarbonate that has been sensitized with a material such as the copper potassium iodide—zinc sulfide additive ("inventive laser enhancing additive") of the above referenced patent applications, we will be able to personalize both the core material and the retroreflective sheeting using the same laser—perhaps even the same laser beam. We also expect that the unique properties of the inventive laser enhancing additive can further improve the quality and performance of the laser engraving of the retroreflective sheeting on the identification document.

We also expect that many different types of digital watermarking may advantageously be combined with the invention. For example, we expect that the laser engraving can be used to embed a steganographic code into the layer of retroreflective sheeting. For example, steganographic code can be embedded into an optically variable grayscale image on the identification document (e.g., an image of a person, such as is provided on a driver's license). The code can be embedded in the master image, or the code can be embedded in perceptually significant features, e.g., facial outlines, hair, etc.

One form of steganographic encoding is digital watermarking. Digital watermarking is a process for modifying physical or electronic media to embed a machine-readable code into the media. The media may be modified such that the embedded code is imperceptible or nearly imperceptible to the user, yet may be detected through an automated detection process. In some embodiments, the identification document includes two or more digital watermarks.

Digital watermarking systems typically have two primary components: an encoder that embeds the digital watermark in a host media signal, and a decoder that detects and reads the embedded digital watermark from a signal suspected of containing a digital watermark (a suspect signal). The encoder embeds a digital watermark by altering the host media signal. The reading component analyzes a suspect signal to detect whether a digital watermark is present. In applications where the digital watermark encodes information, the reader extracts this information from the detected digital watermark. The reading component can be hosted on a wide variety of tethered or wireless reader devices, from conventional PC-connected cameras and computers to fully mobile readers with built-in displays. By imaging a watermarked surface of the card, the watermark's "payload" can be read and decoded by this reader.

Several particular digital watermarking techniques have been developed. The reader is presumed to be familiar with the literature in this field. Some techniques for embedding and detecting imperceptible watermarks in media signals are detailed in the assignee's co-pending U.S. patent application Ser. No. 09/503,881, U.S. Pat. No. 6,122,403 and PCT patent application PCT/US02/20832, which are each herein incorporated by reference.

We have developed various ways to apply retroreflective material (e.g., glass beads) to a document layer. In particular, we have developed various ways to apply retroreflective material in the form of a pre-determined or personalized pattern. The pre-determined pattern may be used to create patterns representing alphanumeric characters, graphics (e.g., an issuer logo, seal or polygonal shape), or other imagery that are common to a batch of documents. The pre-determined pattern may be localized to a particular area on the document where images designed to be viewed through retroreflective material have been placed underneath. This localized placement of retroreflective material in an area frees up the other surface areas of the document for features that might otherwise be obscured by the retroreflective material, such as high DPI security features (e.g., security printing). In this case, the localized placement provides a less expensive and more effective alternative to sheets of retroreflective material that cover the entire document surface.

The personalized pattern may represent similar indicia, yet be personalized to the bearer of the document. For example, the personalized pattern may depict the bearer's demographics (name, date of birth, ID number, etc.).

The general process for applying the retroreflective pattern is as follows:

Step 1. Form a host layer on a document substrate layer in the form of a desired pattern. In some applications, the pattern may be replicated several times on the substrate layer (e.g., in the case of a pre-determined pattern on batch of ID cards that are later die cut from the resulting multilayer structure).

2. Deposit retroreflective beads on the host layer such that the beads adhere to the host layer, forming a retroreflective pattern in the shape of the host layer pattern.

One approach to step 1 is to apply a coating via printing, such as ink jet, screen, or gravure printing. One example of the coating is a UV curable ink or adhesive, such as a UV curable acrylate coating. Ink jet printing is particularly suited for creating personalized printing. In the case of a UV curable coating, the coating is applied in the form of the desired pattern, retroreflective beads are deposited on the coating, and then the coating is cured with a UV curing process.

Another example of step 1 is applying an adhesive, such as a thermoplastic resin, in the form of the pattern. A coating form of the resin may be printed in a similar fashion as the UV curable coating to form the desired personalized or pre-determined pattern. After depositing beads on the adhesive, heat may be used to seal the beads on the adhesive layer.

Yet another example of step 1 is making a mask and applying the mask to the substrate in a manner to form a desired pattern. The mask may is used to form an area where the glass beads are to be deposited (or conversely, are not to be deposited). In one embodiment, a mask is used to prepare a specific area where the beads are to be applied. In this case, the host layer may be applied over the entire surface of the document, yet the mask serves to localize the beads to a particular area covered by the desired pattern.

For example, a sheet of thermoplastic resin may be applied over the entire document surface on the substrate. This resin may represent a film layer that already forms part of the document structure, such as a clear polymer film (e.g., polycarbonate, PVC, polyester, styrene, etc.) laminated to a core layer. Generally, the resin may be any type of polymer that has the property of becoming sufficiently adhesive when preprocessed for adhering beads to it. A typical form of preprocessing used to facilitate the adhesive property is heating the material. To facilitate this heating, an infrared absorbing material is incorporated into the resin. The adhesive area is then localized by applying a mask that limits illumination from an infrared source to the area not covered by the mask.

Conversely, a mask may be used to process surface areas so that the beads do not adhere to them.

One approach to step 2 is to bring the host layer in contact with a bed of retroreflective glass beads, which then adhere to the host layer in the form of the pattern. In particular, the document structure, such as a web of layers from which individual cards are later cut, is passed through a fluidized bath of retroreflective beads, which selectively adhere to the more adhesive areas of the document structure. Air may be percolated through the bed of beads so that they are sufficiently fluidized.

An alternative approach to step 2 is to stamp a sheet of glass beads (e.g., a laminate with an array of glass beads attached to a release layer) onto the host layer to form the pattern.

Yet another approach to step 2 is to powder coat glass beads on the host layer, using a mask to selectively deposit the beads in the form of the desired pattern. In this approach, the host layer and glass beads are suitably charged (e.g., opposite charges) causing them to adhere to each other during the powder coating process.

Retroreflective beads are available from a variety of sources. One form is High Refractive Index glass beads, having diameter in the range of 10 Micron to 2 Mil.

The resulting retroreflective material may be laser engraved to create the features described previously in this document. The retroreflective layer is located at the surface of the document (e.g., top of ID card surface) so that it creates the desired optically variable effects.

The layer of glass beads may also be printed in a structure that has lenticular lens properties. For example, ink jet printing may be used to construct a host layer pattern of lines at the proper lenticular lens spacing, such that when appropriately sized glass beads are adhered to the host layer, the resulting glass bead structure forms a lenticular lens structure. As is known in the art of lenticular lens creation, the lenticular lens spacing is a function of optical parameters. The lenticular lens structure may be positioned relative to pre-printed imagery (personalized or pre-printed image) on the substrate such that the imagery appears to move or have three-dimensional structure when the document is viewed at varying angles through the lenticular lens structure.

Concluding Remarks

Having described and illustrated the principles of the technology with reference to specific implementations, it will be recognized that the technology can be implemented in many other, different, forms, and in many different environments.

The technology disclosed herein can be used in combination with other technologies. Also, instead of ID documents, the inventive techniques can be employed with product tags, product packaging, labels, business cards, bags, charts, smart cards, maps, labels, etc., etc. The term ID document is broadly defined herein to include these tags, maps, labels, packaging, cards, etc.

My inventive methods and techniques apply generally to all identification documents defined above. Moreover, my techniques are applicable to non-ID documents, e.g., such as printing or forming covert images on physical objects, holograms, etc., etc. Further, instead of ID documents, the inventive techniques can be employed with product tags, product packaging, business cards, bags, charts, maps, labels, etc., etc., particularly those items including providing a non-visible indicia, such as an image information on an over-laminate structure. The term ID document is broadly defined herein to include these tags, labels, packaging, cards, etc. In addition, while some of the examples above are disclosed with specific core components, it is noted that—laminates can be sensitized for use with other core components. For example, it is contemplated that aspects of the invention may have applicability for articles and devices such as compact disks, consumer products, knobs, keyboards, electronic components, decorative or ornamental articles, promotional items, currency, bank notes, checks, etc., or any other suitable items or articles that may record information, images, and/or other data, which may be associated with a function and/or an object or other entity to be identified.

To provide a comprehensive disclosure without unduly lengthening the specification, applicants hereby incorporate by reference each of the U.S. patent documents referenced herein.

The technology and solutions disclosed herein have made use of elements and techniques known from the cited documents. Other elements and techniques from the cited documents can similarly be combined to yield further implementations within the scope of the present invention. Thus, for example, single-bit watermarking can be substituted for multi-bit watermarking, technology described as using imperceptible watermarks or encoding can alternatively be practiced using visible watermarks (glyphs, etc.) or other encoding, local scaling of watermark energy can be provided to enhance watermark signal-to-noise ratio without increasing human perceptibility, various filtering operations can be employed to serve the functions explained in the prior art, watermarks can include subliminal graticules to aid in image re-registration, encoding may proceed at the granularity of a single pixel (or DCT coefficient), or may similarly treat adjoining groups of pixels (or DCT coefficients), the encoding can be optimized to withstand expected forms of content corruption, etc.

Thus, the exemplary embodiments are only selected samples of the solutions available by combining the teachings referenced above. The other solutions necessarily are not exhaustively described herein, but are fairly within the understanding of an artisan given the foregoing disclosure and familiarity with the cited art. The particular combinations of elements and features in the above-detailed embodiments are exemplary only; the interchanging and substitution of these teachings with other teachings in this and the incorporated-by-reference patent documents are also expressly contemplated.

In describing the embodiments of the invention illustrated in the figures, specific terminology is used for the sake of clarity. However, the invention is not limited to the specific terms so selected, and each specific term at least includes all technical and functional equivalents that operate in a similar manner to accomplish a similar purpose.

We claim:

1. A secure document comprising:

a core layer;

a retroreflective material applied to the core layer, the retroreflective material being on a surface of the secure document, and wherein different directional grayscale images are laser engraved in the same location on the retroreflective material at corresponding first and second angles of incidence wherein the different directional images laser engraved at the same location represent different types of information about a bearer of the secure document; and wherein the retroreflective material is selectively applied to an area, but less than the entire area of the surface and forming a pre-determined or personalized pattern; and wherein, the laser engraving is carried out with a neodymium:yttrium aluminum garnet (Nd:YAG) laser having a wavelength output of about 1064 nm, operating at 10 watts maximum, a beam diameter of about 2.3 mm to 10 mm, and a frequency of about 50 Khz.

2. The document of claim 1 comprising a host layer shaped in the form of the pre-determined or personalized pattern, the retroreflective material comprising beads selectively embedded in the pattern.

3. The document of claim 1 comprising a host layer, the retroreflective material comprising beads selectively embedded in the host layer in a shape of the pattern.

4. The document of claim 1 wherein the pattern comprises a pattern conveying personal information of a bearer of the document.

* * * * *